United States Patent [19]

Bernhardt et al.

[11] Patent Number: 4,488,546

[45] Date of Patent: Dec. 18, 1984

[54] RELEASE MECHANISM FOR RETENTION MEANS FOR OXYGEN MASKS

[75] Inventors: Jost Bernhardt, Hamburg; Georg Hase, Wedel/Holstein, both of Fed. Rep. of Germany

[73] Assignee: Bernhardt Apparatebau GmbH & Co., Hamburg, Fed. Rep. of Germany

[21] Appl. No.: 507,172

[22] Filed: Jun. 23, 1983

[51] Int. Cl.[3] ..... A62B 7/00

[52] U.S. Cl. ..... 128/201.23; 74/2

[58] Field of Search ..... 128/201.23, 206.27, 128/207.11; 74/2; 2/6, 421, 424

[56] References Cited

U.S. PATENT DOCUMENTS

| | | | |
|---|---|---|---|
| 3,035,573 | 5/1962 | Morton, Jr. et al. | 128/201.23 |
| 3,080,582 | 3/1963 | Reffell | 74/2 |
| 3,234,940 | 2/1966 | Morton, Jr. | 128/206.27 |

*Primary Examiner*—Henry J. Recla

*Attorney, Agent, or Firm*—Becker & Becker, Inc.

[57] ABSTRACT

A device which, under the effect of water, separates the cartridge-like receiving means and the connector of a retainer for an oxygen mask, preferably for pilots. The receiving means is connected with a support, for example a helmut on the head of a person, and the connector, to which the oxygen mask is attached, is safely held in the receiving means with securing elements which are under tension and which can be released by a bracket mounted on the connector. The device includes a housing which is held directly on the connector. A spring bolt, which can be moved against the force of a compression spring, is guided in the housing. A lever arm which can shift the bracket is mounted on the spring bolt. A self-acting element, which loses its rigidity in water, and which holds the compression spring in the tensioned position, acts on the spring bolt.

10 Claims, 5 Drawing Figures

RELEASE MECHANISM FOR RETENTION MEANS FOR OXYGEN MASKS

BACKGROUND OF THE INVENTION

The present invention relates to a device for use in connection with a retention means for an oxygen mask, preferably for pilots; the retention means includes a cartridge-like receiving means, which is connected with supporting means, for example a helmut, on the head of a person, for a connector to which the oxygen mask is attached; the retention means also includes securing elements which are under tension, which safely hold the connector in the receiving means, and which can be released by a bracket which is mounted on the connector.

A retention means of the aforementioned general type is known from U.S. Pat. No. 3,035,573, which was issued to W. D. Morton, Jr., et al, on May 22, 1962. With this heretofore known retention means, in order to be able to take off the oxygen mask, the latching must be released by pulling on the bracket or bayonet member by hand. This can be a drawback if the pilot, when bailing out of the aircraft during an emergency, lands in water and, for example due to exhaustion or loss of consciousness, can no longer actuate the bracket. The danger then exists that the breathing hose of the oxygen mask enters the water and the person who is experiencing the emergency drowns or suffocates since an unimpeded breathing via the breathing hose is no longer assured.

It is therefore an object of the present invention to further develop the retention means of an oxygen mask in such a way that, while maintaining an unproblematic manual operation, and unaffected by acceleration forces or other effects, the latching mechanism is automatically released when it becomes immersed in water.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
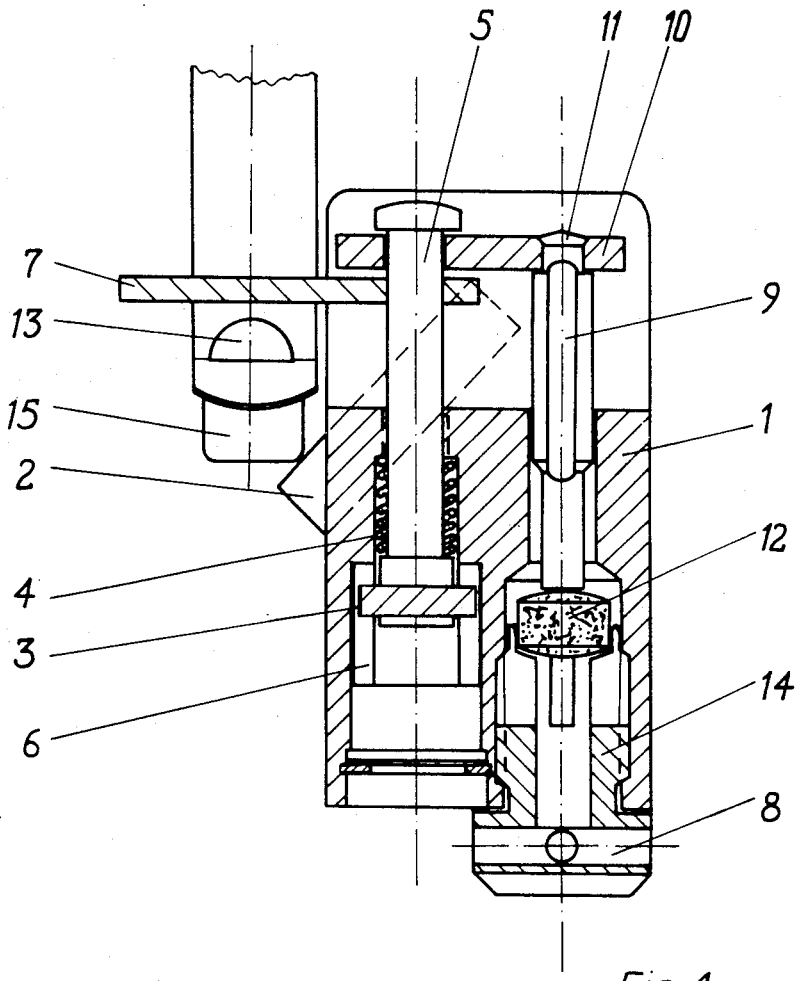
FIG. 1 is a schematic sectional view, in the ready to use state, of one inventive embodiment of a water sensitive release mechanism for the retention means of an oxygen mask.

The device of the present invention is characterized primarily in that a release mechanism, which becomes operative upon immersion in water, is operatively associated with the connector for releasing the latter, which is held in the receiving means, by shifting the bracket.

In the ready to use state, the inventive release mechanism is set in such a way that it does not act upon the bracket, and therefore the retention means can be operated as previously. Upon immersion in water, the release mechanism is activated and shifts the bracket for releasing the securing elements which hold the connector in the receiving means. Operatively associating the release mechanism with the connector means that only one element of the release mechanism, which element has a very small weight, engages the bracket, and therefore acceleration forces proceeding from the release mechanism are not transferred to the bracket which releases the securing elements, as a result of which a release of the retention means and hence a removal of the oxygen mask at the wrong time is precluded.

Pursuant to a preferred specific embodiment of the present invention, the release mechanism is provided with a spring bolt which is guided in a housing and can be moved against the force of a compression spring; a lever arm which shifts the bracket is fastened on the spring bolt; a self-acting element, which loses its rigidity in water, and which holds the compression spring in the tensioned position is operatively associated with the spring bolt. In order to achieve as compact a construction of the release mechanism as possible, a pin can be guided in the housing parallel to the spring bolt; the pin may be operatively connected with the spring bolt by means of a crossbar, and the self-acting element may engage the pin for the purpose of tensioning the compression spring. Pursuant to further advantageous specific embodiments of the present invention, the pin may be provided with a longitudinal groove which extends over more than the length of that portion of the pin which is guided in a bore of the housing. It is also possible to dispose the compression spring in a cylindrical chamber of the spring bolt. The lever arm, which is fastened to the spring bolt, may be guided in a right-angled slot of the housing, with one leg of the slot extending parallel to the axis of the housing. In order to again make such a release mechanism ready for use after automatic release of the retention means, it is only necessary to again tension the compression spring by inserting a new water-sensitive self-acting element, whereby the bracket, and hence the securing elements of the connector, automatically return to the latching position. For this purpose, the self-acting elements may be accommodated in a bushing which can be screwed into the housing for engagement against the spring bolt or the pin.

Pursuant to another expedient further development of the inventive release mechanism, the spring bolt may be provided with a transverse pin which, when the compression spring is tensioned, is guided in slots in the housing. On the one hand, this assures that when the release mechanism is ready for use, the lever arm, which is attached to the spring bolt, is always in the working path of the bracket. On the other hand, it is possible, when the compression spring is tensioned, to pivot the lever arm out of the working path of the bracket in order to engage or catch the connector in the receiving means even when the release mechanism is actuated; this may be necessary if the release mechanism is activated at the wrong time, for example due to problems with the self-acting element.

Pursuant to yet another proposal of the present invention, a coil spring, which is supported against the receiving means, may be disposed on the connector.

DESCRIPTION OF PREFERRED EMBODIMENTS

Figure 2:
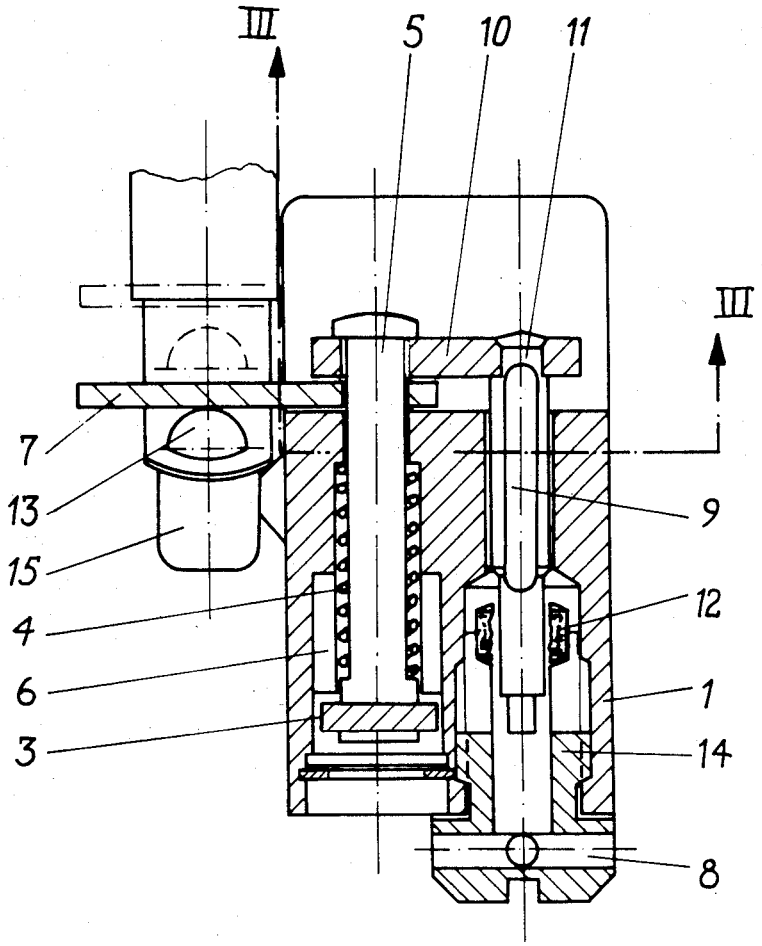
FIG. 2 is a schematic sectional view through the activated release mechanism of FIG. 1.
Figure 3:
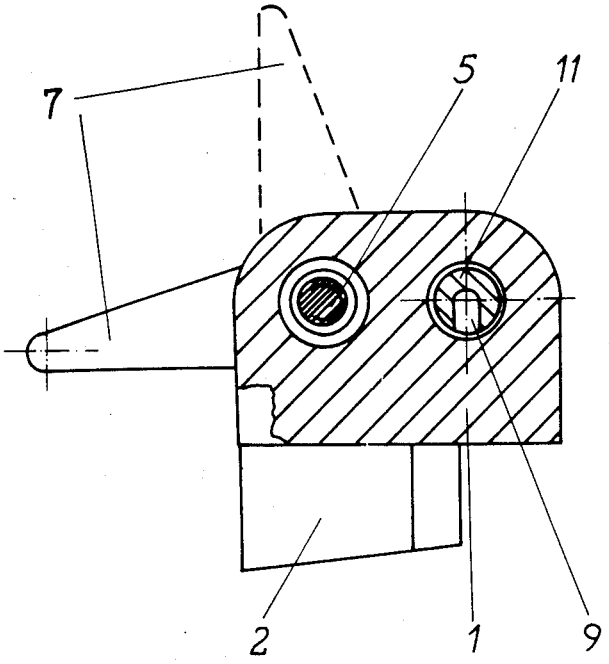
FIG. 3 is a schematic sectional view taken along the line III—III in FIG. 2.

Referring now to the drawings in detail, the inventive release mechanism illustrated in FIGS. 1, 2, and 3 comprises a housing 1 having two parallel through-bores. A spring bolt 5 is guided in one of the bores, and can be moved against the force of a compression spring 4. One end of the spring bolt 5, on which a lever arm 7 is mounted, projects out of the housing 1. The lever arm 7 rests against a bracket 15 which, as a release element, is attached to a non-illustrated connector of the retention means of an oxygen mask, such as one illustrated in the aforementioned U.S. Pat. No. 3,035,573. An extension 2 of the housing 1 is fastened to this connector. The spring bolt 5 is provided with a transverse pin 3, the ends of which, when the compression spring 4 is tensioned, are guided in slots 6 in the housing 1.

A pin 11 is arranged in the other bore of the housing 1. One end of the pin 11 is operatively connected via a crossbar 10 with that end of the spring bolt 5 which carries the lever arm 7. A self-acting element 12 rests against the other end of the pin 11 within the bore of the housing. The element 12 is held and guided in a bushing 14 which is screwed into the housing 1.

In the ready for use state, the water-sensitive self-acting element 12 holds the pin 11 in the position shown in FIG. 1, as a result of which the compression spring 4 is tensioned by means of the crossbar 10 which engages the pin 11 and the spring bolt 5. In so doing, the ends of the transverse pin 3 are located in the slot 6 of the housing 1, and the lever arm 7 does not contact the bracket 15 which releases the retention means for the oxygen mask. If the self-acting element 12 comes into contact with water, which enters the housing 1 via transverse bores 8 in the bushing 14 and/or a longitudinal groove of the pin 11, which groove extends over more than the length of that section of the pin 11 which is guided in the wall of the housing, the self-acting element 12 loses its rigidity. As a result, the compression spring 4 can relax and can pull the spring bolt 5 into the housing 1 into the position shown in FIG. 2. In so doing, the lever arm 7 comes into engagement with a raised portion 13 on the bracket 15 and displaces the bracket 15 out of the position illustrated by dot-dash lines in FIG. 2 into the position shown by solid lines, in which position the bracket 15 releases the retention means of the oxygen mask, so that, due to the weight of the oxygen mask, the connector is automatically disconnected from the receiving means of the retention means.

When the compression spring 4 is relaxed, the ends of the transverse pin 3 are no longer guided in the slots 6 of the housing 1 (FIG. 2), so that the spring bolt 5 is rotated about its axis, and therefore the lever arm 7 can be pivoted into the dashed-line position shown in FIG. 3 out of the working path of the bracket 15. As a result, it is possible, even when the compression spring 4 is relaxed, i.e. when the release mechanism is activated, for the bracket 15 to return to the latching or normal position, so that the connector can also engage in the receiving means of the retaining means during this operating state of the release mechanism.

In order to tension the compression spring 4 and hence to again make the release mechanism ready for operation, which is effected by inserting a new self-acting element 12 into the bushing 14, the lever arm 7 must, if necessary, be put back into the working path of the bracket 15 and thereby brought into operative connection with the bracket 15, since otherwise the ends of the transverse pin 3 could not enter the slots 6 of the housing 1.

Figure 4:
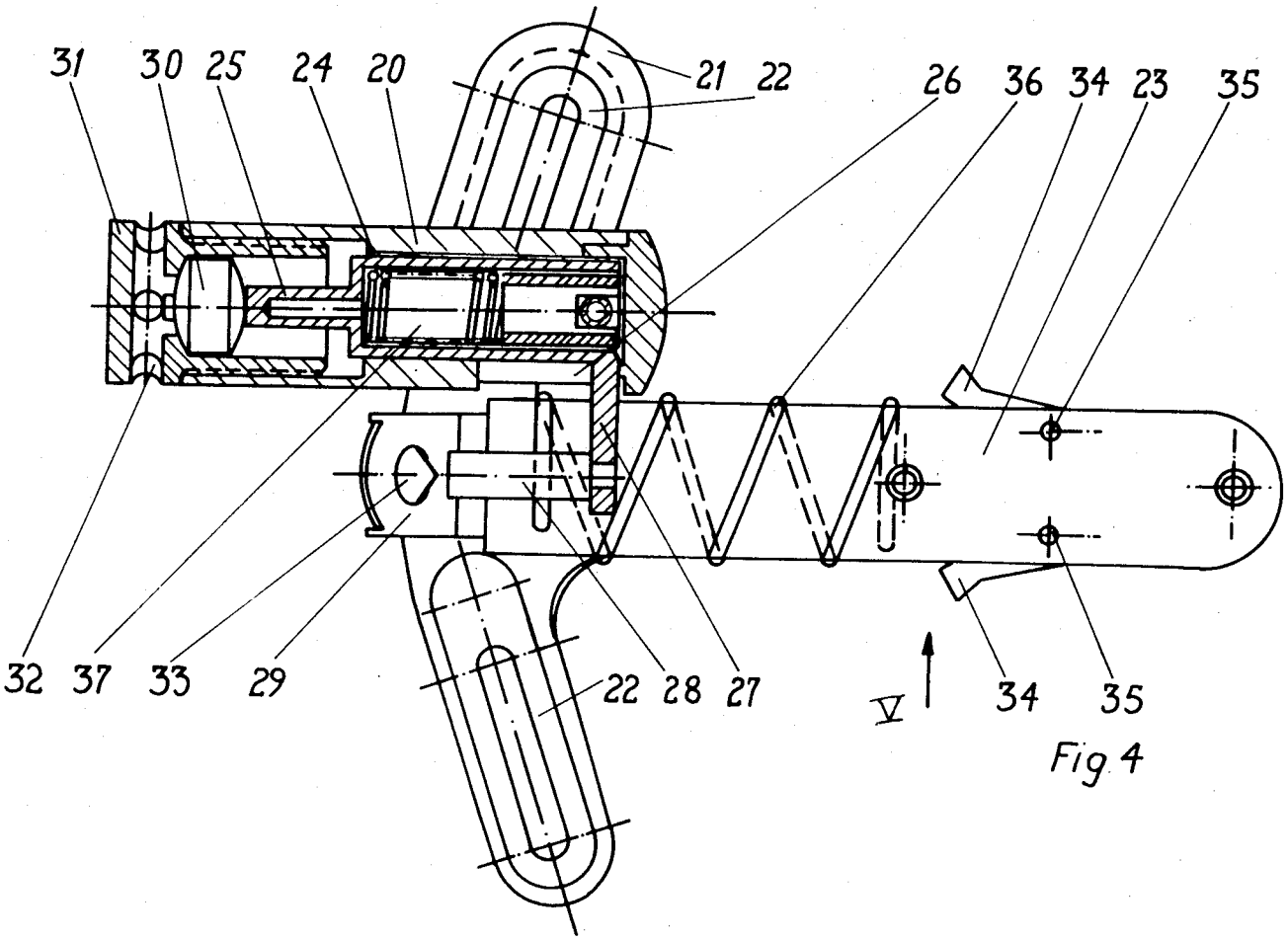
FIG. 4 is a schematic sectional view, in the ready to use state, taken along the line IV—IV in FIG. 5 of another inventive embodiment of a release mechanism.
Figure 5:
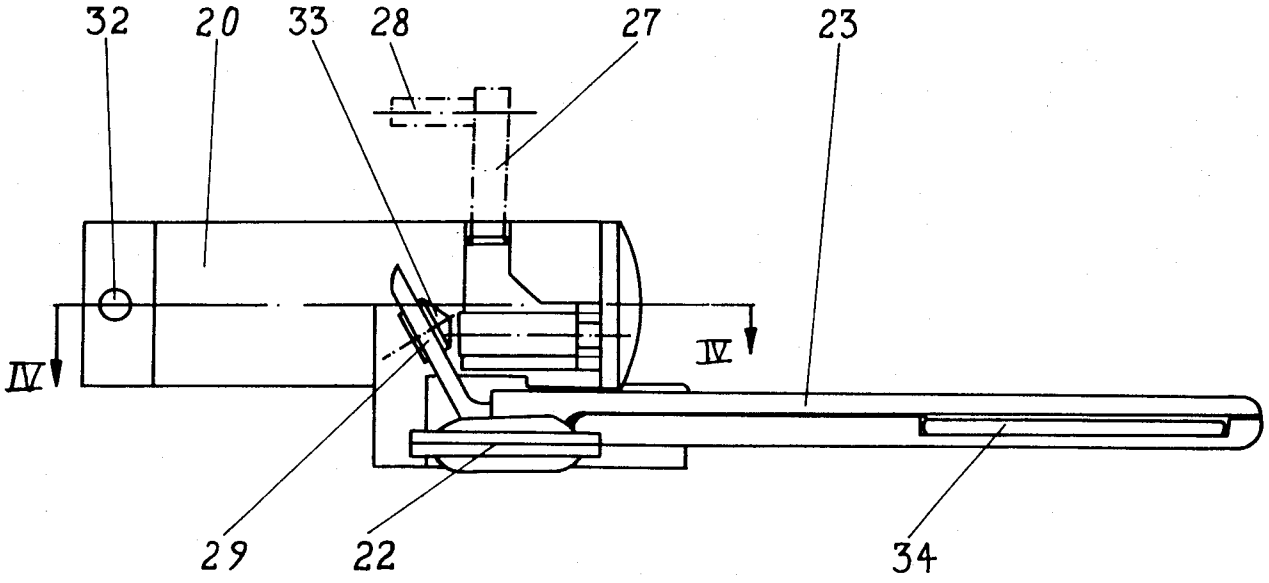
FIG. 5 is a schematic view of the release mechanism of FIG. 4 taken in the direction of arrow V.

With the inventive embodiment of the release mechanism illustrated in FIGS. 4 and 5, the housing 20 has only one bore. Furthermore, a U-shaped bracket or yoke 21 of the housing 20 is fastened to a lateral leg 22 of the connector 23 of a retention means of an oxygen mask similar to the one illustrated in the aforementioned U.S. Pat. No. 3,035,573. The spring bolt 25 is guided in this bore and can be moved against the force of the compression spring 24. To reduce the dimensions of the release mechanism, the compression spring 24 is arranged in a cylindrical chamber 37 of the spring bolt 25. A lever arm 27, which projects out of a right-angled slot 26 in the housing 20, is attached to one end of the spring bolt 25. The lever arm 27 is provided with a pin 28 which, as an adjustment member, acts on the bracket 29 of the connector 23. The tablet-shaped self-acting element 30, which holds the compression spring 20 in the tensioned position (FIG. 4), engages the other end of the spring bolt 25. The element 30, which loses its rigidity in water, is held and guided in a bushing 31 which is screwed into the housing 20.

In the ready to use state of the release mechanism (FIG. 4), the lever arm 27 is guided in that leg of the right-angled slot 26 of the housing 20 which extends parallel to the axis of the housing. Furthermore, the pin 28 on the lever arm 27 does not contact the bracket 29 of the connector 23, which bracket 29 serves for release of the retention means of the oxygen mask.

As mentioned above, the self-acting element 30 loses its rigidity when it comes into contact with water, which enters the housing 20 via transverse bores 32 in the bushing 31. As a result, the compression spring 24 can relax, and the spring bolt 25 can be displaced in the direction of the bushing 31. In so doing, the pin 28 on the lever arm 27 engages a raised portion 33 on the bracket 29 and displaces the bracket 29, so that the latter releases the retention means due to the fact that securing elements 34, which project laterally from the connector 23, are pivoted about their centers of rotation 35 in such a way that they come to rest within the connector 23. The connector 23 can now be freed from the associated receiving means of the retention means due to the weight of the oxygen mask, which, although it is not illustrated, is attached by means of straps to the legs 22 of the connector 23. Release of the connector 23 is aided by a coil spring 36 which is arranged on the connector 23 and is supported on the legs 22 and the receiving means.

When the compression spring 24 is relaxed, the lever arm 27 rests on that leg of the slot 26 of the housing 20 which extends at right angles to the axis of the housing, so that the spring bolt 25 is turned about its axis, and the lever arm 27, together with the pin 28, can be pivoted out of the working path of the bracket 29 into the position shown with dot-dash lines in FIG. 5. As a result, as described in connection with the release mechanism of FIGS. 1–3, the bracket 29 can be returned to the latching and normal position, even when the release mechanism is activated.

To tension the compression spring 24, a new self-acting element 30 must be placed in the bushing 31, and the lever arm 27, if necessary, must be pivoted until it is located in the working path of the bracket 29.

Although only two specific embodiments have been illustrated and described, various other modifications are also possible. In particular, the release mechanism may be immovably held on the connector, and its elements which actuate the bracket may have a slight mass.

The present invention is, of course, in no way restricted to the specific disclosure of the specification and drawings, but also encompasses any modifications within the scope of the appended claims.

What we claim is:

1. In combination with a retention means adapted to be connected between an oxygen mask and head supporting means, which retention means includes a cartridge-like receiving means adapted to be supported to said head supporting means and a connector adapted to be connected to said oxygen mask; said retention means further including tensioned securing elements which removably hold said connector in said receiving means; bracket means being attached to said connector for releasing said securing elements, and hence said connector, from said receiving means;

a release mechanism which is operatively connected to said connector; said release mechanism including self-acting means responsive upon immersion in water, to shift said bracket means to effect said release of said securing elements, and hence said connector, from said receiving means.

2. A combination according to claim 1, in which said release mechanism includes:

a housing mounted on said connector;

a spring bolt, which is guided in said housing;

a compression spring associated with said housing and with said spring bolt; said spring bolt being movable against the force of said compression spring;

a lever arm connected to said spring bolt and positioned with respect to said bracket to effect said shifting of said bracket; and said self-acting means being operatively associated with said spring bolt to hold said compression spring in a tensioned position, said self-acting means being rigid when dry, and losing its rigidity in water.

3. A combination according to claim 2, which includes a pin which is guided in said housing parallel to said spring bolt; a crossbar operatively connecting said pin with said spring bolt; said self-acting means engaging said pin for effecting said operative association thereof with said spring bolt, and for tensioning said compression spring.

4. A combination according to claim 3, in which said housing is provided with a first bore for guiding a portion of said pin therein; and in which said pin is provided with a longitudinal groove which extends over more than the length of that portion of said pin which is guided in said first bore of said housing.

5. A combination according to claim 4, in which said housing is provided with slots; and in which said spring bolt is provided with a transverse pin having ends which are guided in said slots when said compression spring is tensioned.

6. A combination according to claim 3, which includes a bushing which is screwed into said housing in alignment with said pin and is adapted to effect said engagement of said self-acting element against said pin.

7. A combination according to claim 2, which includes a bushing which is screwed into said housing in alignment with said spring bolt and is adapted to effect said operative association of said self-acting means against said spring bolt.

8. A combination according to claim 2, in which said spring bolt is provided with a cylindrical chamber; and in which said compression spring is disposed in said cylindrical chamber.

9. A combination according to claim 8, in which said housing is provided with a right-angled slot, one leg of which extends parallel to the axis of said housing; and in which said lever arm, which is connected to said spring bolt, is guided in said right-angled slot.

10. A combination according to claim 1, which includes a coil spring which is disposed on said connector and is supported against said receiving means of said retention means.

* * * * *